United States Patent [19]

Tone

[11] Patent Number: 4,846,142

[45] Date of Patent: Jul. 11, 1989

[54] METHOD AND APPARATUS FOR RELEASING THE TENSION ON THE BOWSTRING AND BUSS CABLES OF A COMPOUND ARCHERY BOW

[75] Inventor: Richard Tone, Gilbert, Ariz.

[73] Assignee: Hoyt/Easton Archery Co., Inc., Salt Lake City, Utah

[21] Appl. No.: 162,095

[22] Filed: Feb. 29, 1988

[51] Int. Cl.[4] ..... F41B 5/00

[52] U.S. Cl. ..... 124/90; 124/DIG. 1; 29/235

[58] Field of Search ..... 124/23 R, 23 A, 24 R, 124/90, 86, DIG. 1; 29/235

[56] References Cited

U.S. PATENT DOCUMENTS

| | | | |
|---|---|---|---|
| 3,207,145 | 9/1965 | Browning et al. | 124/23 R |
| 4,074,409 | 2/1978 | Smith | 124/23 R |
| 4,077,385 | 3/1978 | Fredrickson | 124/DIG. 1 |
| 4,180,045 | 12/1979 | Kingsley | 124/90 |
| 4,515,142 | 5/1985 | Nurney | 124/23 R |

*Primary Examiner*—Randolph A. Reese
*Assistant Examiner*—Anthony Knight
*Attorney, Agent, or Firm*—Mallinckrodt & Malinckrodt

[57] ABSTRACT

A compound archery bow with apparatus for releasing the tension on the bowstring and buss cables when it is desired to replace or adjust the bowstring, buss cables, or eccentrics, includes posts or hooks mounted on each limb of the bow on a portion thereof which is displaced toward the other limb as the bow is drawn, and over which the end of a length of holding material may be secured. It is preferred that such posts or hooks be provided as part of the normally present V-groove washer assemblies. The invention includes the method for releasing the tension on the bowstring and buss cables by providing the above indicated posts or hooks, drawing the bow, securing the ends of a length of holding material to the posts or hooks so that the holding material extends between them and wherein the length of the holding material between the posts or hooks is less than the distance between such posts or hooks in undrawn or braced position, and moving the bowstring back to undrawn position so that the holding means becomes taut and tension is released from the bowstring and buss cables.

18 Claims, 2 Drawing Sheets

METHOD AND APPARATUS FOR RELEASING THE TENSION ON THE BOWSTRING AND BUSS CABLES OF A COMPOUND ARCHERY BOW

BACKGROUND OF THE INVENTION

1. Field: The invention is in the field of methods and devices for holding the limbs of a compound archery bow in stressed condition with bowstring and buss cables in loosened condition so that the bow string, buss cable, or eccentrics may be easily replaced or adjusted.

2. State of the Art: Archery bows have always required periodic replacement of the bow string. Modern compound archery bows not only require periodic replacement of the bow string, but also periodic replacement of the buss cables and sometimes require the adjustment of the bow string, buss cables, or of the eccentrics over which the buss cables are sheaved. The replacement of a bow string or buss cable or the adjustment of the bow string, buss cables, or eccentrics cannot be accomplished with tension on the bow string and buss cables. Thus, this tension must be released.

In some compound bows, the bow limbs are adjustably secured to the bow handle by limb bolts which can be tightened or loosened to change the stress on the bow limbs. With such bows, the limb bolts can be loosened to an extent to completely release the stress on the bow limbs and thereby release all tension on the bow string and buss cables. In this condition the bow string, buss cables, or eccentrics may be easily replaced or adjusted. After replacement or adjustment, the limb bolts are tightened to again stress the bow limbs.

The problem with this procedure is that once the limbs are loosened, it is difficult to tighten them again to the exact extent to which they were previously tightened to place the desired stress on the bow limbs and to provide the desired tune for the bow. Also, such process is difficult and time consuming and is not easy to perform in the field.

There are a number of devices currently available to hold the limbs of a bow in a stressed condition to thereby allow the adjustment or replacement of bow strings, buss cables or eccentrics. While these devices are generally advantageous from the standpoint of maintaining the desired adjustment of limb tension and bow tune, they are an additional piece of equipment that must be carried by the archer and are sometimes bulky and inconvenient to carry.

A more convenient way of holding the limbs in stressed condition to take the tension off the bowstring, buss cables, and eccentrics would be desireable.

SUMMARY OF THE INVENTION

According to the invention, an archery bow is provided with a means for securing the end of a length of flexible holding material on each limb intermediate its length and on a portion thereof which is displaced toward the opposite limb as the bow is drawn. In a compound bow, these means may conveniently take the form of a loop receiving post incorporated as part of the usual V groove washer assembly on a bow limb, and the flexible holding material may be an auxiliary bow string with looped ends and of a length such that when the bow is at least partially drawn and opposite looped ends of the auxiliary bow string placed about the loop receiving posts on opposite bow limbs, when the bow is released from its partially drawn position, the limbs are held in a stressed condition whereby tension is released from the bow string, buss cables and eccentrics.

The method of the invention includes the steps of producing means for securing the ends of a length of flexible holding material on each limb on a portion thereof which is displaced toward the opposite limb as the bow is drawn, drawing the bow, and when in drawn or partially drawn position, attaching the ends of a length of flexible holding material to the securing means to hold the bow limbs in the drawn or partially drawn position. When held in such position, releasing the bowstring from drawn position will loosen the bowstring and buss cables and allow easy replacement or adjustment of the bowstring, buss cables, or eccentrics. During the practice of this method, the bow will generally be drawn by placing the handle of the bow on the ground with limbs extending outwardly and upwardly therefrom so that the bowstring extends parallel to the ground but spaced upwardly therefrom. The bow is held in position by a users foot or feet and the bowstring is then drawn by the user with one hand to cause the outer portions of the limbs to move toward one another, at which time the length of holding material is secured between the limbs by the other hand of the user. Once the holding material is secured in place, the bowstring is released which removes the tension from the bowstring and buss cables.

THE DRAWINGS

In the accompanyiing drawings which illustrate the best mode presently contemplated for carrying out the invention:

FIG. 1 is a side elevation of a compound archery bow in braced position;

FIG. 2, a side elevation of a compound archery bow similar to FIG. 1, but with the bow limbs held in stressed position by operation of the invention with tension released from the bow string, buss cables, and eccentrics;

FIG. 3, a fragmentary vertical elevation taken on the line 3—3 of FIG. 2, showing the V groove washer assembly and drawn to a larger scale;

FIG. 4, a fragmentary vertical section taken on the line 4—4 of FIG. 3;

FIG. 5, a fragmentary vertical elevation similar to that of FIG. 3, but showing a second embodiment of the invention; and FIG. 6, a fragmentary vertical section taken on the line 6—6 of FIG. 5.

DETAILED DESCRIPTION OF THE ILLUSTRATED EMBODIMENT

Figure 1:
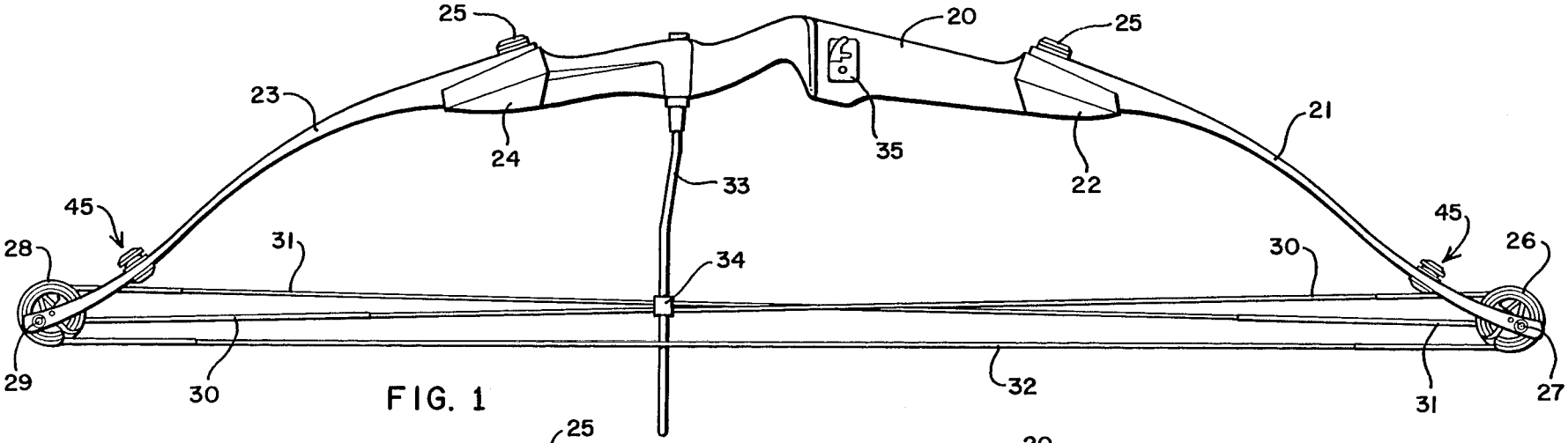

A compound bow is shown in FIG. 1 having a handle section 20 with an upper limb 21 secured to and extending from the upper end 22 thereof and a lower limb 23 secured to and extending from the lower end 24 thereof. The limbs are secured to the handle section by respective limb bolts 25. The outer ends of the limbs are split so that an upper eccentric 26 is pivotally mounted by axle 27 for eccentric rotation at the outer end of upper limb 21 and a lower eccentric 28 is pivotally mounted by axle 29 for eccentric rotation at the outer end of lower limb 23.

A buss cable 30 extends from attachment to lower limb 23 to upper eccentric 26. Similarly, a buss cable 31 extends from attachment to upper limb 21 to lower eccentric 28. A bowstring 32 extends between the upper and lower eccentrics. While the bow shown has a cabling system in which the buss cables and the ends of the bowstring are connected directly to the respective eccentrics 26 and 28, any cabling arrangement may be used such as the presently more common system wherein end portions of the respective buss cables 30 and 31 extend through and partially about the respective eccentrics 26 and 28 with ends extending therefrom toward the opposite limbs and having the well known teardrops secured thereto for holding the looped ends of the actual bowstring which stretches between the teardrops, to thereby provide a bowstring extending between the upper and lower eccentrics. The use of the term "eccentrics" in relation to the items pivotally mounted on the limb tip of the bow are not meant to indicate any particular shape for the eccentrics, such eccentrics being round in many instances, but merely indicates that such item provides for eccentric movement of the effective point of attachment of the bowstring in relation to the limb tips as in all traditional compound bows.

The bow of FIG. 1 has an optional cable glide bar 33 extending from handle 20 rearwardly therefrom in normal manner with cable glide block 34 holding buss cables 30 and 31 to offset the cables in normal manner. Also, an arrow rest 35 is mounted on bow handle 20 in standard fashion.

Figure 3:
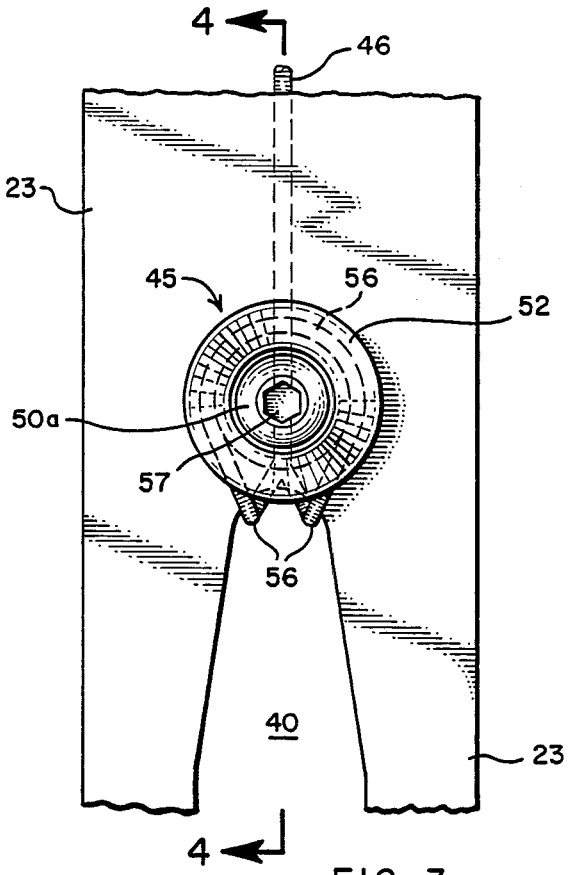
Figure 4:
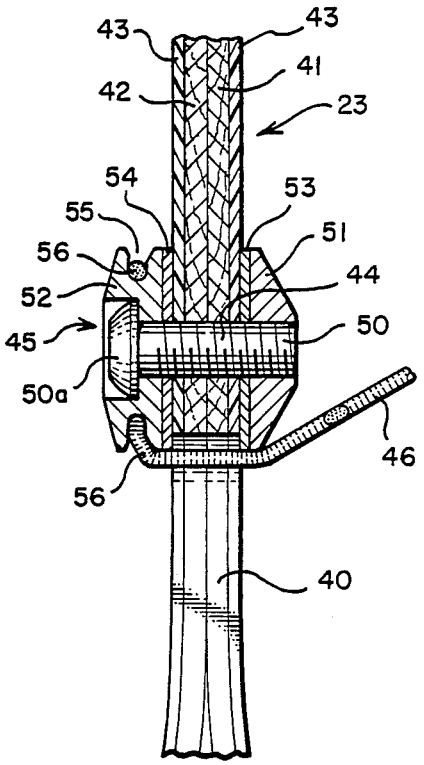
Figure 5:
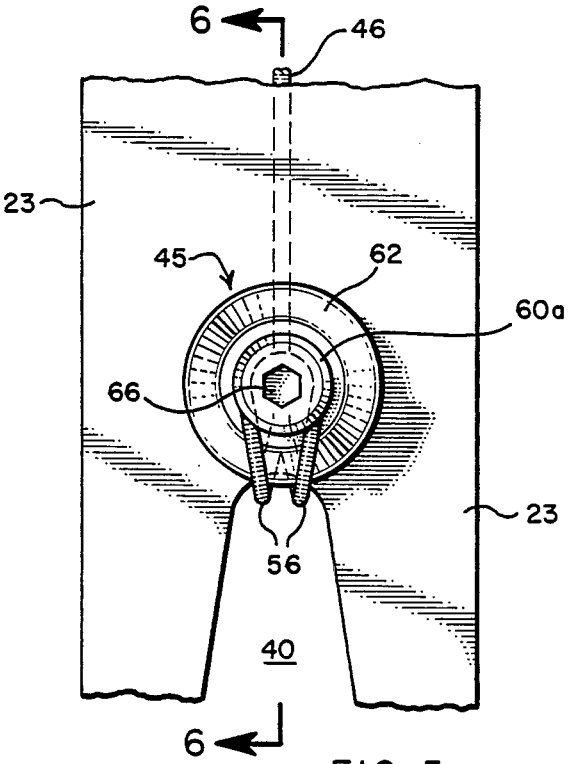
Figure 6:
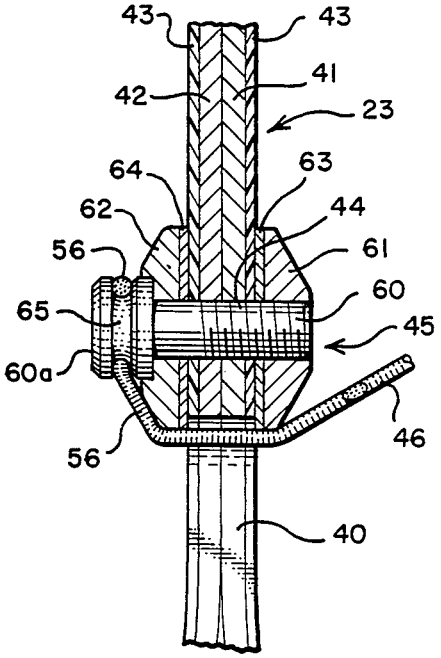

As indicated above, and as partially seen in FIGS. 3 and 5, the ends of the bow limbs are split in what is commonly called a V-groove so that the eccentrics may be pivotally mounted thereon. Thus, for example, as shown in FIGS. 3 and 5, lower limb 23 has a slit or V-groove 40 therein at its end. Although limb construction can vary greatly, FIGS. 4 and 6 show the limbs made of two pieces of maple 41 and 42 laminated together and sandwiched between outer layers of fiberglass reinforced resin 43. This is standard construction for fiberglass reinforced bow limbs. With limbs of this construction, as with most compound bow limbs regardless of construction, a hole is drilled through the limb just inwardly of the end of the V-groove. This hole, 44 in FIGS. 4 and 6, provides a stress relief for the bow limb so that if the limb begins to split at the base of the V-groove the split will only travel to the stress relief hole 44 and stop. In order to help prevent splitting of the limb at all at the base of the V-groove, and in order to fill the stress relief holes, it is common practice to provide a V-groove washer assembly shown generally as 45.

Figure 2:
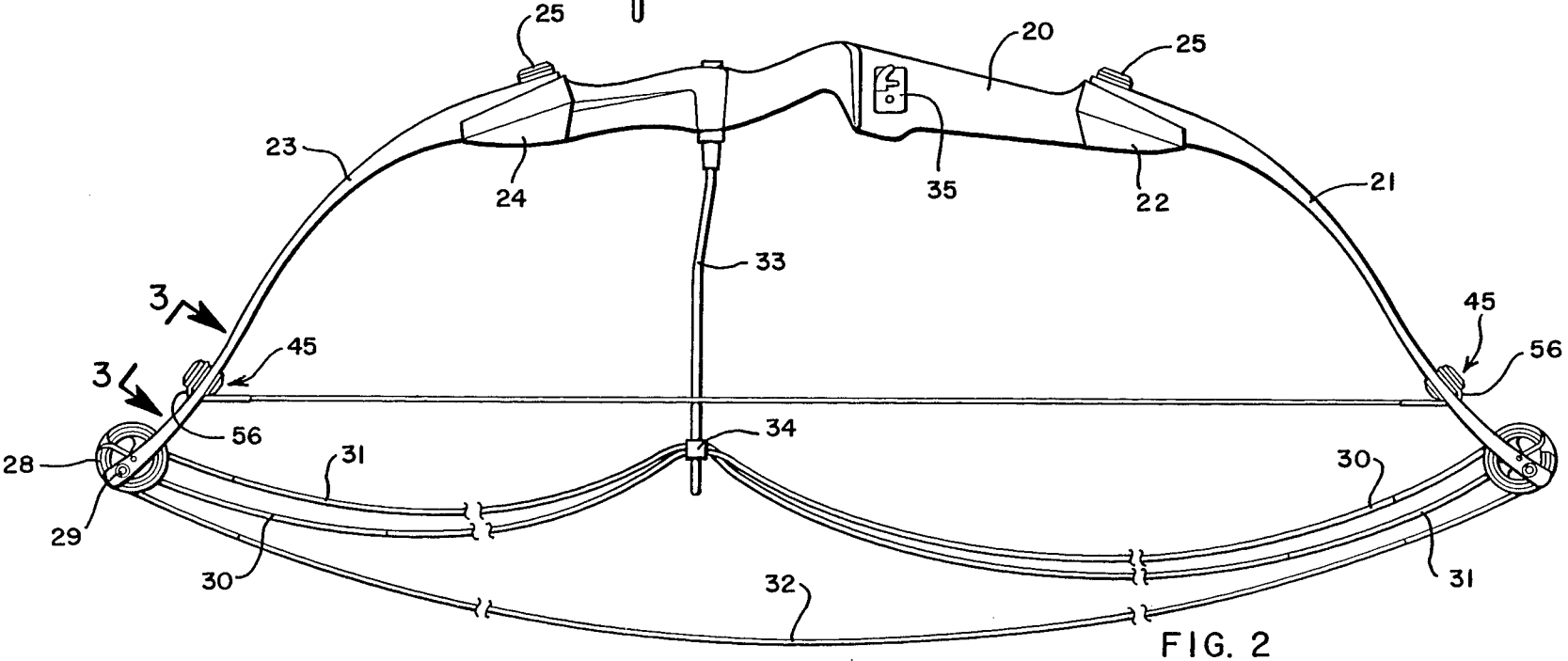

With compound archery bows, it is periodially necessary to replace or adjust the bowstring, the buss cables, or the eccentrics. Even with the bow in its undrawn or braced position as shown in FIG. 1, the limbs are stressed and substantial tension is present on the buss cables and bowstring. It is impossible to adjust or replace a bowstring, a buss cable, or an eccentric with this tension present. When a bow is drawn, more stress is placed on the limbs as the drawing of the string moves the ends of the bow limbs towards one-another. The bow limbs in a partially drawn positions are shown in FIG. 2. The present invention involves securing a length of holding material 46 between the limbs of the bow when in the stressed, drawn position or in a partially drawn position so that the limbs are held in this position eventhough the bowstring is released. With bow limbs held in the drawn or partially drawn position, tension can be released from the bowstring, buss cables, and eccentrics, as shown in FIG. 2. In this condition, the bowstring, buss cables, or eccentrics may be easily removed, adjusted, or replaced.

The holding material 46 may be in the form of an auxiliary bowstring, or made similarly to a bowstring, with looped ends. Means are provided on each bow limb for attaching the holding material to the bow limb. Since most compound bows have V-groove washer assemblies and these assemblies are positioned on the outer portions of the limbs which move toward one-another when the bow is drawn, the presently preferred form of the invention provides means as part of the V-groove washer assemblies for receiving and holding the preferred looped ends of the holding material.

Referring to FIGS. 3 and 4, a V-groove washer assembly which provides the means of the invention for securing the ends of the holding material to the limbs includes a cap screw 50 with head **50*a* threaded into threaded washer 51. A cap washer 52 is positioned between cap screw head 50*a* and the bow limb. Cap screw 50, threaded washer 51, and cap washer 52 are preferably made of metal such as aluminum or stainless steel. Thin, nylon or fiber washer 53 is positioned between threaded washer 51 and bow limb 23 while a similar thin, nylon or fiber washer 54 is positioned between cap washer 52 and bow limb 23. Washers 53 and 54** protect the finish of the bow limb.

Cap washer 52 is configured to provide a groove 55, FIG. 4, extending about its circumference which will accept and hold the looped end 56 of holding material 46. The head **50*a* of cap screw 50 has the normal hex opening 52** therein which accepts an allen wrench so that the assembly can be tightened or loosened.

FIGS. 5 and 6 show a second embodiment of a V-groove washer assembly which includes a cap screw 60 with head **60*a*, threaded washer 61, cap washer 62 and thin washers 63 and 64. In this embodiment, a groove 65 is formed in head 60*a* of cap screw 60, rather than in cap washer 62. The groove 65 accepts and holds loop 56 of holding material 46. Again, cap screws 60 have the normal hex opneing 66** therein which accepts an allen wrench so that the assembly can be tightened or loosened.

In use of the invention, when it is desired to release the tension from the bowstring and buss cables so that the bowstring, buss cables, or eccentrics can be adjusted or replaced, the handle of the bow may be placed on the ground so that the limbs extend outwardly and upwardly from the handle and the bowstring is substantially parallel to the ground but spaced above it. The handle is held in position by the foot or feet of a user and the bowstring grasped by one hand of the user and drawn either to a fully drawn or partially drawn position wherein the bow limbs and V-groove washer assemblies 45 thereon are moved closer together. The looped ends 56 of holding material 46 are placed in the receiving grooves of the respective V-groove washer assemblies by the user with his other hand. Normally, one end of the holding material will be secured to the securing means on one of the limbs and extended toward the other limb prior to drawing the bow so that only one end needs to be secured to a bow limb securing means while the bow is held in drawn position. As shown, the groove 55 for holding the holding material is located on the outer side of each limb so that the holding material extends from the receiving means through the V-groove of that limb, across to the V-groove of the opposite limb, and then around to the holding groove of the securing means on that limb.

Once the looped ends of the holding material are in place about the Vgroove washer assemblies, the bowstring is moved back toward its braced position. Upon such movement of the bowstring, the limbs move outwardly again until the holding material 46 becomes taut at which time the limbs are held in that position. Further release of the bowstring is not accompanied by further travel of the bow limbs so the bowstring and buss cables become slack as shown in FIG. 2. The relative positions of the bow limbs from the undrawn position to the partially drawn position at which the limbs are held by holding material 46 are shown in FIGS. 1 and 2, respectively. With the tension released from the bowstring and buss cables and with slack in the bowstring and buss cables as shown in FIG. 2, it is easy for a user to replace or adjust the bowstring, buss cables, or eccentrics.

After replacement or adjustment of the bowstring, buss cables, or eccentrics is complete, the bow is again held by the feet of a user and the bowstring drawn by hand of the user to draw the limbs and V-groove washer assemblies sowewhat closer together than shown in FIG. 2 to release the tension on holding material 46 so that one of the looped ends can be removed from its holding groove and the bowstring then moved back to braced position shown in FIG. 1. The other end of the holding material is then removed from its securing means, the holding material removed and the bow is ready for use.

Rather than a user holding the bow with his feet and drawing it with one hand so that the other hand is free to place the holding material about its securment means, if the user has an assistant, the user can draw the bow in normal manner with one hand holding the handle and the other holding the bowstring, and the assistant can secure the holding material in place between the bow limbs.

The length of the securing material must be such that when secured to the apporiate bow limbs, the length of the material which stretches between the bow limbs is shorter than the distance between the same point on the bow limbs when the bow is in braced or undrawn position. Unless this length is shorter, the tension on the bowstring and buss cables will not be released. It has been found that the holding material may conveniently take the form of a length of dacron or other bowstring material with looped ends as is normal for a bowstring or of a length of steel cables such as used in many bows for the buss cables. With the invention, the only thing the user need carry to enable him to release tension on the bowstring is the length of holding material which is easy and lightweight to carry.

In bows that have a groove or split at the ends of the limbs, but do not provide a stress relief hole or V-groove washer assembly, a V-groove washer assembly of the invention may easily be placed at the bottom of the groove and tightened against the bow to provide the securing means of the invention. Alternatively, various other types or locations for the securing means may be used. For example, a hook could extend inwardly from the respective V-groove washer assemblies for securing and holding the looped ends of the holding material, or, the loop receiving and securing means for the holding material could be located on the handle portion of the bow, such as about the limb bolts 25. In such instance, the holding material would extend from one limb bolt 25, along the outside of the bow limb to the base of the V-groove, through the V-groove, across the bow to the base of the V-groove of the opposite limb through such opposite V-groove, along the outside of the opposite limb to the other limb bolt 25. With such arrangement, and for purposes of this description, the base of the V-groove through which the holding material passes is considered as part of the securing means and such V-groove bases are located on a portion of the bow limbs which travel toward one-another when the bow is drawn.

While various securing means could be used, the securing means shown as part of the V-groove washer assemblies are preferred because they are easily incorporated into the V-groove washer assemblies with minimum addition of weight to the assemblies and do not extend from the bow substantially further than the usual Vgroove washer assemblies so do not interfere with the normal use, storage, or transportation of the bow. In addition, no additional holes through the limbs of a bow are needed.

The method of the invention includes the steps of providing holding material securing means on each of the limbs of a compound bow on a portion of the bow limb which travels toward the opposite limb as the bow is drawn, drawing the bow to the extent necessary to move the securing means toward one-other, securing the holding material to the securing means while the bow is held in such drawn position, and moving the bowstring back toward undrawn position whereby tension is placed on the length of holding material and relived from the bowstring and buss cables.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A compound archery bow comprising a handle section; a pair of limbs extending from the handle section and having free outer opposite ends and a V-groove in each of the free opposite ends; a V-groove washer assembly on each of the limbs; an eccentric mounted for eccentric rotation on the free outer end of each of the limbs; buss cables coupling each of the eccentrics to the limb opposite that to which it is mounted; a bowstring extending between the eccentrics; and means on each bow limb and associated with respective V-groove washer assemblies for receiving and securing an end of a length of holding material, said securing means being located so that the distance between said securing means becomes shorter as the bow is drawn, whereby, when the bow is drawn, a length of holding material having an effective length shorter than the distance between the securing means when the bow is in undrawn position secured between the securing means will hold the limbs in a partially drawn position and relieve tension on the bowstring and buss cables as the bow is released from drawn position.

2. A compound archery bow according to claim 1, wherein the securing means are grooves about a portion of respective V-groove washer assemblies for receiving and securing a looped end of a length of holding material.

3. A compound archery bow according to claim 2, wherein the V-groove washer assemblies each include a threaded cap screw having an enlarged head; a threaded washer adapted to receive the threaded cap screw; and a cap washer positioned between the head of the cap screw and the threaded washer, said assembly adapted to be positioned with respect to the bow limb so that upon tightening of the cap screw, a portion of the bow limb is sandwiched between the cap washer and threaded washer, said cap washer having a groove thereabout to receive the looped end of a length of holding material.

4. A compound archery bow according to claim 2, wherein the V-groove washer assemblies each include a threaded cap screw having an enlarged head; a threaded washer adapted to receive the threaded cap screw; and a cap washer positioned between the head of the cap screw and the threaded washer, said assembly adapted to be positioned with respect to the bow limb so that upon tightening of the cap screw, a portion of the bow limb is sandwiched between the cap washer and threaded washer, said enlarged head having a groove thereabout to receive the looped end of a length of holding material.

5. In a compound archery bow including a handle section; a pair of limbs extending from the handle section and having free outer opposite ends and a V-groove in each of the free opposite ends; a V-groove washer assembly on each of the limbs; an eccentric mounted for eccentric rotation on the free outer end of each of the limbs; buss cables coupling each of the eccentrics to the limb opposite that to which it is mounted; and a bowstring extending between the eccentrics; the improvement comprising means on each bow limb and associated with respective Vgroove washer assemblies for receiving and securing an end of a length of holding material, said securing means being located so that the distance between said securing means becomes shorter as the bow is drawn, whereby, when the bow is drawn, a length of holding material having an effective length shorter than the distance between the securing means when the bow is in undrawn position secured between the securing means will hold the limbs in a partially drawn position and relieve tension on the bowstring and buss cables as the bow is released from drawn position.

6. The improvement in a compound archery bow according to claim 5, wherein the securing means are grooves about a portion of respective V-groove washer assemblies for receiving and securing a looped end of a length of holding material.

7. The improvement in a compound archery bow according to claim 6, wherein the V-groove washer assemblies each include a threaded cap screw having an enlarged head; a threaded washer adapted to receive the threaded cap screw; and a cap washer positioned between the head of the cap screw and the threaded washer, said assembly adapted to be positioned with respect to the bow limb so that upon tightening of the cap screw, a portion of the bow limb is sandwiched between the cap washer and threaded washer, said cap washer having a groove thereabout to receive the looped end of a length of holding material.

8. The improvement in a compound archery bow according to claim 6, wherein the V-groove washer assemblies each include a threaded cap screw having an enlarged head; a threaded washer adapted to receive the threaded cap screw; and a cap washer positioned between the head of the cap screw and the threaded washer, said assembly adapted to be positioned with respect to the bow limb so that upon tightening of the cap screw, a portion of the bow limb is sandwiched between the cap washer and threaded washer, said enlarged head having a groove thereabout to receive the looped end of a length of holding material.

9. A V-groove washer assembly for a compound archery bow having a pair of limbs each with an outer end with a groove extending inwardly from the outer end, comprising a threaded cap screw having an enlarged head; a threaded washer adapted to receive the threaded cap screw; and a cap washer positioned between the head of the cap screw and the threaded washer, said assembly adapted to be positioned with respect to the bow limb so that upon tightening of the cap screw, a portion of the bow limb is sandwiched between the cap washer and threaded washer, said cap washer having a groove thereabout to receive the looped end of a length of holding material.

10. A V-groove washer assembly according to claim 9, wherein a hole is provided through the bow limb adjacent the end of the groove therein and wherein the cap screw passes through said hole.

11. A V-groove washer assembly for a compound archery bow having a pair of limbs each with an outer end with a groove extending inwardly from the outer end, comprising a threaded cap screw having an enlarged head; a threaded washer adapted to receive the threaded cap screw; and a cap washer positioned between the head of the cap screw and the threaded washer, said assembly adapted to be positioned with respect to the bow limb so that upon tightening of the cap screw, a portion of the bow limb is sandwiched between the cap washer and threaded washer, said enlarged head having a groove thereabout to receive the looped end of a length of holding material.

12. A V-groove washer assembly according to claim 11, wherein a hole is provided through the bow limb adjacent the end of the groove therein and wherein the cap screw passes through said hole.

13. A method of releasing the tension on the bowstring and buss cables of a compound archery bow having a handle section, a pair of bow limbs extending outwardly from the handle section, eccentrics mounted on the outward ends of the bow limbs, and stringing including buss cables and a bowstring, comprising the steps of providing on each bow limb, on a portion thereof which is displaced toward the other bow limb when the bow is drawn, means for securing an end of a length of holding material; drawing the bow to an extent necessary to displace the securing means toward one-another; while holding the bow in drawn position, securing the ends of a length of holding material to the securing means so that a length of the holding material extends between the securing means on opposite bow limbs, the length of the holding material between said securing means being less than the distance between the securing means when the bow is in undrawn position, and allowing the bowstring to move back toward undrawn position so that the holding means becomes taut and tension on the bowstring and buss cables is released.

14. A method of releasing the tension on the bowstring and buss cables of a compound archery bow according to claim 13, wherein the step of securing the ends of a length of holding material to the securing means includes the step of placing a looped end of the holding means about the securing means.

15. Apparatus for releasing the tension on the bowstring and buss cables of a compound archery bow having a handle section, a pair of bow limbs extending outwardly from the handle section, eccentrics mounted on the outward ends of the bow limbs, and stringing including buss cables and a bowstring, comprising means on each bow limb for receiving and securing an end of a length of holding material, said securing means being located so that the distance between said securing means becomes shorter as the bow is drawn; and a length of holding material with ends adapted to be secured to the securing means so that the holding material extends therebetween, the effective length of said holding material being such that when the bow is in undrawn position, the holding material cannot be secured between the securing means, but when the bow is in drawn position and the distance between the securing means is shorter than when the bow is in undrawn position, the holding material can be secured between the securing means, whereby, when the bow is drawn and the length of holding material is secured between the securing means, the length of holding material will hold the limbs in a partially drawn position and relieve tension on the bowstring and buss cables as the bow is released from its drawn position.

16. Apparatus for releasing the tension on the bowstring and buss cables of a compound archery bow according to claim 15, wherein each of the bow limbs has a V-groove washer assembly thereon and wheren the securing means are associated with respective V-groove washer assemblies.

17. Apparatus for releasing the tension on the bowstring and buss cables of a compound archery bow according to claim 16, wherein the length of holding material has looped ends and wherein the securing means are grooves about a portion of respective V-groove washer assemblies for receiving and securing a looped end of the length of holding material.

18. Apparatus for releasing the tension on the bowstring and buss cables of a compound archery bow according to claim 15, wherein the length of holding material has looped ends and wherein the securing means are adapted to receive and hold the looped ends of the length of holding material.

* * * * *